US005486451A

United States Patent [19]

Vacca et al.

[11] Patent Number: 5,486,451

[45] Date of Patent: Jan. 23, 1996

[54] METHOD OF PREPARING SILVER HALIDE PHOTOGRAPHIC EMULSIONS

[75] Inventors: Alberto Vacca, Carcare; Paolo Barletta, Merana, both of Italy

[73] Assignee: Minnesota Mining and Manufacturing Company, St. Paul, Minn.

[21] Appl. No.: 285,938

[22] Filed: Aug. 4, 1994

[30] Foreign Application Priority Data

Sep. 23, 1993 [EP] European Pat. Off. ..... 93115320

[51] Int. Cl.[6] ..... G03C 1/047; G03C 11/06

[52] U.S. Cl. ..... 430/569; 430/642; 430/627; 430/634; 430/635; 430/636

[58] Field of Search ..... 430/569, 642, 430/627, 634, 635, 636

[56] References Cited

U.S. PATENT DOCUMENTS 3,168,403 2/1965 Himmelmann et al. ..... 430/629

3,436,220 4/1969 Dersch et al. ..... 430/642

3,884,701 5/1975 De Pauw et al. ..... 430/628

4,391,903 7/1983 Sysak ..... 430/629

FOREIGN PATENT DOCUMENTS 892464 3/1962 United Kingdom .

OTHER PUBLICATIONS

Research Disclosure 308119, Dec. 1989.

*Primary Examiner*—Charles L. Bowers, Jr.
*Assistant Examiner*—Mark F. Huff
*Attorney, Agent, or Firm*—Gary L. Griswold; Walter N. Kirn; Mark A. Litman

[57] ABSTRACT

A method is disclosed of preparing washed silver halide photographic emulsions wherein silver halide grain formation is effected in the presence of an acid-coagulable gelatin derivative or a mixture of gelatin and an acid-coagulable gelatin derivative and coagulation of the emulsion occurs in the presence of ionic copolymers of styrene sulfonic acid and maleic acid.

14 Claims, No Drawings

METHOD OF PREPARING SILVER HALIDE PHOTOGRAPHIC EMULSIONS

FIELD OF THE INVENTION

The present invention relates to a method of preparing washed silver halide photographic emulsions, and in particular to a method of preparing washed silver halide photographic emulsions by the coagulation washing method.

BACKGROUND OF THE INVENTION

Silver halide photographic emulsions are conventionally prepared by reacting an aqueous alkali metal halide or ammonium halide solution with an aqueous silver salt solution, e.g. silver nitrate, in the presence of a protective colloid, e.g. gelatin, to cause precipitation of small silver halide nuclei. After physical ripening to the desired average grain size, the emulsion is subjected to chemical ripening.

At the conclusion of the physical ripening, the photographic emulsions contain soluble by-products and excess halides which should be removed.

The soluble by-products and excess halides can be removed by chill-setting the emulsion, comminuting it into small fragments and washing by suspending in water, as illustrated in U.S. Pat. Nos. 2,316,845 and 3,396,027. Other methods include coagulation washing as illustrated in U.S. Pat. Nos. 2,618,556, 2,614,928, 2,565,418, 3,241,969, 2,489,341, and in GB Pat. Nos. 1,305,409 and 1,167,159; centrifugation and decantation of the coagulated emulsion as illustrated in U.S. Pat. Nos. 2,463,794, 3,707,378, 2,996,278 and 3,489,454; employment of hydrocyclones alone or in combination with centrifuges as illustrated in GB Pat. Nos. 1,336,692 and 1,356,573; diafiltration with a semipermeable membrane as illustrated by Research Disclosure 10208, October 1972, Research Disclosure 13122, March 1975, DE Pat. Appl. No. 2,436,461, U.S. Pat. No. 2,495,918, or with an ion-exchange resin as illustrated by US Pat. Nos. 3,782,953 and 2,827,428.

Preferred methods of emulsion washing are those based on coagulation washing. Coagulation washing is based on the principle of causing the gelatin to coagulate so that it settles together with the silver halide grains and thus separates from the aqueous solution comprising the soluble by-products. The supernatant solution is decanted and the settled gelatin-silver halide complex is redispersed, after washing of the precipitate, in water or aqueous gelatin. The coagulation washing method offers a number of advantages; in particular, a high percentage of unwanted by-products can be removed in one stage, concentrated silver halide emulsions can be prepared, and the process is simple and inexpensive. Coagulation is conventionally effected by addition of inorganic electrolites, such as ammonium, potassium and sodium sulfate, as described in U.S. Pat. No. 2,618,556; acid-coagulable gelatin derivatives, as described in U.S. Pat. Nos. 2,494,041, 2,614,928, 2,614,929, 2,728,662, 2,768,079, 2,787,545, 2,956,880, 3,118,766, 3,132,945, 3,138,461, 3,359,110 and 3,867,154; anionic soaps, as described in U.S. Pat. No. 2,489,341 and 2,527,260; polymeric compounds containing carboxyl groups, as described in U.S. Pat. No. 2,565,418; polymeric compounds containing sulfo groups, as described in U.S. Pat. No. 3,137,576; and polymeric compounds containing both carboxyl and sulfo groups, as described in U.S. Pat. No. 3,168,403 and 3,241,969. It is also known to combine different coagulating agents in coagulation washing of silver halide emulsions; for example, GB 892,464 discloses the combination of the cleavage product of a keratin-containing substance and heavy metal salts, U.S. Pat. No. 3,436,220 discloses the combination of polyoxyalkylenated derivatives of gelatin and polystyrene sulfonic acid or ammonium sulfate, and U.S. Pat. No. 3,884,701 discloses the combination of an acid-coagulable gelatin derivative and a low molecular weight polystyrene sulfonic acid.

The importance of coagulation washing method is illustrated by the large selections of variants of the method which have been suggested. However, the coagulation washing methods so far proposed have been found to suffer from one or more disadvantages which greatly reduce their over-all effectiveness. For example, considerable amounts of time are consumed while waiting for the coagulate to settle, particularly when the coagulate is redispersed and reprecipitated to repeat the washing step more than once, as is ordinarily done. In addition, such methods present considerable difficulty in connection with washing operations which usually require considerable amounts of water and time. Moreover, there are difficulties in using known coagulation washing methods for the coagulation of very fine grain silver halide emulsions, such as those used in Graphic Arts films, in that undesired sedimentation and agglomeration of silver halide grains may occur.

Ionic copolymers of styrene sulfonic acid and maleic acid are disclosed in auxiliary antistatic layers of silver halide photographic elements, as described, for example, in U.S. Pat. No. 4,460,679, 4,585,730, 4,891,308, 4,960,687 and in EP 391,402 and 391,176. Ionic copolymers of styrene sulfonic acid and maleic acid are also disclosed in U.S. Pat. No. 4,391,903 to improve covering power when added to gelatin binder employed in medical silver halide X-ray emulsions.

SUMMARY OF THE INVENTION

The invention provides a method of preparing a light-sensitive silver halide emulsion comprising the steps of precipitating the silver halide in the presence of an acid-coagulable gelatin derivative, coagulation washing the formed precipitate and redispersing the silver halide, characterized in that coagulation proceeds in the presence of ionic copolymers of styrene sulfonic acid and maleic acid.

By means of this invention, the rate of settling of coagulates is greatly improved, the volume of water employed in the washing steps and the number and time of washing steps are reduced, and concentrated silver halide emulsions free from by-products and grain sedimentation can be obtained.

DETAILED DESCRIPTION OF THE INVENTION

The present invention provides a method of preparing a washed silver halide photographic emulsion in which silver halide grains are formed in the presence of an acid-coagulable gelatin derivative and wherein the undesirable by-products of silver halide emulsion are removed by lowering the pH to bring about coagulation and by washing the coagulum, the method being characterized by the fact that said coagulation is effected in the presence of an ionic copolymer of styrene sulfonic acid and maleic acid. The ionic copolymer for use in the present invention is a copolymer of styrene sulfonic acid and maleic acid having at least some of the sulfonic acid groups converted to a salt by ammonium or alkali metal cations.

The first step of the method of the present invention comprises preparation of a silver halide in a water solution of a hydrophilic colloid, at a pH above 4, preferably above 5, and a temperature generally comprised between about 35° C. and about 70° C., by mixing a water soluble silver salt (usually silver nitrate) with a water solution of a water-soluble halide (usually an ammonium halide or a halide of an alkali metal, such as sodium or potassium). The hydrophilic colloid may be dissolved in either or both of these solutions, or in a separate solution. The hydrophilic colloid used in this silver halide precipitation or emulsification step comprises substantially an acid-coagulable gelatin derivative. The term "substantially' is intended to signify that at least 50%, preferebly at least 80%, and more preferably 100% by weight of the hydrophilic colloid used in the emulsification step is comprised of the acid-coagulable gelatin derivative, the remaining percent of hydrophilic colloid being normal gelatin or other hydrophilic colloidal substances not acid-coagulable, for example proteins such as albumin and casein, cellulose derivatives such as hydroxyethyl cellulose, carboxymethyl cellulose and cellulose sulfuric acid esters, sugar derivatives such as sodium alginate and starch derivatives, and various synthetic hydrophilic polymers and copolymers such as polyvinyl alcohol, partial acetals of polyvinyl alcohol, polyvinyl pyrrolidone, polyacrylic acid, polymethacrylic acid, polyacrylamide, polyvinyl imidazole and polyvinyl pyrazole.

The acid-coagulable gelatin derivatives for use in the present invention include reaction products of gelatin with organic carboxylic or sulfonic acid chlorides, carboxylic acid anhydrides, aromatic isocyanates or 1,4-diketones. The term "gelatin" as used herein is intended to signify the colloid binder manufactured from the protein collagen and used in photographic manufacturing, which has the property of colloid protection for silver halide grains as well as other requirements, such as crosslinkability and swelling. Examples of organic carboxylic acid chlorides include phthalyl chloride, p-nitrobenzoyl chloride, benzoyl chloride and furoyl chloride. Examples of organic sulfonic acid chlorides include benzene sulfonyl chloride, p-methoxybenzene sulfonyl chloride, p-phenoxybenzene sulfonyl chloride, p-bromobenzene sulfonyl chloride, m-nitrobenzene sulfonyl chloride, p-toluene sulfonyl chloride, naphthalene-β-sulfonyl chloride, 3-nitro-4-aminobenzene sulfonyl chloride, 3-carboxy-4-bromobenzene sulfonyl chloride, quinoline-8-sulfonyl chloride, m-carboxybenzene sulfonyl chloride and 2-amino-5-methylbenzene sulfonyl chloride. Examples of carboxylic acid anhydrides include phthalic anhydride, benzoic anhydride, succinic anhydride, maleic anhydride, trimellitic acid anhydride and isatoic anhydride. Examples of aromatic isocyanates include phenyl isocyanate, p-bromophenyl isocyanate, p-chlorophenyl isocyanate, p-tolyl isocyanate, p-nitrophenyl isocyanate, beta-naphthyl isocyanate. Examples of 1,4-diketones include acetonyl acetone, dimethyl acetonyl acetone and diethyl diacetyl succinate. Processes for preparing acid-coagulable gelatin derivatives are described for example in U.S. Pat. No. 2,494,041, 2,614,928, 2,614,929, 2,728,662, 3, 118,766. Acid-coagulable gelatin derivatives obtained by reaction with acid chlorides or acid anhydrides, especially phthaloyl gelatin, and isocyanates, especially N-phenylcarbamoyl gelatin, are preferred for use in accordance with the present invention.

The term "emulsification" as utilized herein is intended to include all steps used in the art in effecting dispersion of silver halide grains into a hydrophilic colloid such as "digestion" of the silver halide dispersion, the later term including the usual steps of heating, to a greater or lesser extent, in the presence or absence of other chemicals (such as ripening agents, stabilizers, and the like), the silver halide dispersion to produce the desired grain size, grain size distribution, and grain sensitivity.

In the practice of the present invention, the silver halide is prepared in an aqueous solution comprising the acid-coagulable gelatin derivative as the peptizing agent alone or in combination with normal gelatin. The silver halide may be prepared by any of the usual methods for the preparation of the silver halide emulsions such as for example by introducing an aqueous solution of the silver nitrate and an aqueous solution of at least one ammonium or alkali metal halide into a stirred aqueous solution of the peptizing agent. Alternatively, the acid-coagulable gelatin derivative may be combined with one of the reactants, i.e., the silver salt or the halide, and the other reactants may be introduced thereinto by stirring. Following silver halide precipitation, the silver halide emulsion may be subjected to any physical ripening or digestion operations considered advisable.

After the emulsification step, the silver halide emulsion comprising the acid-coagulable gelatin derivative is coagulated by lowering the pH of the emulsion to a value below 4, e.g., by means of diluted sulfuric acid, citric acid, acetic acid, etc., in the presence of the ionic copolymer of is styrene sulfonic acid and maleic acid. The ionic copolymer of styrene sulfonic acid and maleic acid may be added at the end of the emulsification step before physical ripening. However, it is preferred to add the ionic copolymer of styrene sulfonic acid and maleic acid after physical ripening, immediately before the lowering of the pH. The ionic copolymer of styrene sulfonic acid is preferably used in an amount of about 5% to about 60% by weight, preferably about 10% to about 40% by weight, relative to the amount of acid-coagulable gelatin derivative used in the emulsification step. Coagulation may occur at a temperature comprised between about 10° C. and about 50° C.

The ionic copolymer for use in the present invention is a water-soluble (e.g., soluble in water at room temperature for at least 5% in weight, preferably for at least 10%) copolymer having monomer units comprising:

(a) a water-soluble salt of a styrene sulfonic acid, such as an alkaline metal or ammonium salt, and (b) maleic acid, the molar ratio of (a) to (b) being at least 1:1 up to 9:1, and optionally (c) another ethylenically unsaturated monomer (molar proportions of 0:1 to 0.5:1 may be used for (c)/(b)).

The ionic copolymer may have a molecular weight (Mw, a weight average molecular weight of 5,000 to 1 million, preferably 10,000 to a half million.

Preferably, the ionic copolymer is a copolymer of sodium styrene sulfonate and maleic acid in a 2:1 to 4:1 mole ratio. For example, monomer (a) may be styrene sulfonic acid, vinyltoluene sulfonic acid, alpha-methyl-styrene sulfonic acid, in the form of alkali metal salts thereof, preferably Na or K, or ammonium salts. Monomer (c), if present, is to be chosen so as not to negatively effect water solubility and coagulation capability of the copolymers for use in the present invention. Examples of to monomers (c) are ethylenic monomers (such as isoprene, 1,3-butadiene, vinyl chloride, ethylene, propylene), styrene type monomers (such as styrene, vinyltoluene, alpha-methyl-styrene, 2-ethyl-styrene, 1-vinylnaphthalene), 2-alkenoic acid esters (such as methyl, ethyl, propyl, butyl, hexyl esters of acrylic, methacrylic, alpha-ethylacrylic, alpha-propylacrylic, 2-butenoic acids), acrylamide monomers (such as acrylamide, N-methylacrylamide, N,N-dimethylacrylamide, N-butylacrylamide, N-chloromethylacrylamide) and vinyl acetate.

Examples of ionic polymers include poly(sodium styrene sulfonate-maleic acid), poly(potassium styrene sulfonate-maleic acid), poly(sodium styrene sulfonate-butyl acrylatemaleic acid), and the like. These ionic polymers may be purchased commercially or synthesized by copolymerizing the monomers as known in the art.

By lowering the pH, the silver halide emulsion forms floccules which settle to form a coagulum. The coagulum thus formed may be separated from the liquid by any suitable technique, such as for example by removing the supernatant mother liquid by decantation or by means of a siphon. In some cases, the coagulum thus obtained may be used directly without any further treatment. However, in many instances it is preferred to reduce further the content of water soluble salts which may be present using several methods. For example, the coagulum may washed out with cold water (which may be demineralized or not) once or several times. Alternatively, washing may be effected by redispersing the coagulum in water using a small amount of alkali, e.g., sodium or ammonium hydroxide, at elevated temperatures, recoagulating by addition of acid and subsequently removing the supernatant liquid. This procedure of redispersion and recoagulation may be repeated as many times is necessary. As another alternative method of washing, the coagulum is redispersed in water by reducing the pH to values below the coagulation point (which is approximately below 2) whereupon recoagulation may be effected by addition of alkali to raise the pH to the coagulation point and the supernatant liquid is removed.

The coagulum, after the washing operation for removing by-products and water soluble salts, may be redispersed in a hydrophilic colloid, to produce a composition suitable for finishing and coating operations of a photographic emulsion. Redispersion is usually effected by treating the coagulum, at a temperature preferably between about 35° C. and about 60° C., with water, a hydrophilic colloid and, if necessary, alkali until a pH value of 4.5–8 is reached, for a time sufficient to redisperse the coagulum. The hydrophilic colloid is preferably normal is gelatin or other known photographic hydrophilic colloid such as gelatin derivatives as referred to above, albumin, casein, cellulose derivatives, such as hydroxyethyl cellulose and carboxymethyl cellulose, polyvinyl alcohol, polyacrylamide, etc.

The silver halide photographic emulsions prepared according to the method of the present invention may be digested or chemically sensitized according to any of the methods known in the art of photography, such as those disclosed in Research Disclosure 308119, December 1989, page 996. Before coating on a support, the silver halide emulsion may be added of one or more coating finals known in the art, such as spectral sensitizers, brighteners, antifoggants and stabilizers, color formers, absorbing dyes, hardeners, coating aids, plasticizers and lubricants, antistatic agents, matting agents, development modifiers, etc., such as those described in Research Disclosure 308119, December 1989.

The silver halide photographic emulsions prepared according to the method of the present invention may be coated onto the various types of supports known in the art such as, for example, glass, paper, metal, polymeric films such as cellulose acetate, polycarbonate, polystyrene, polyethylene terephthalate, polyvinyl acetate, etc., as described in Research Disclosure 308119, December 1989, page 1009.

Any of the customarily employed washed emulsions can be prepared by the present method, e.g., silver bromide, silver bromoiodide, silver chlorobromide, silver chlorobromoiodide, silver chloride, silver chloroiodide, etc., emulsions.

In particular, the method of the present invention results useful in the preparation of washed monodispersed, high chloride and fine grain silver halide emulsions. The term "monodispersed" referes to an emulsion having a coefficient of grain size variation lower than 45%, preferably lower than 35%, more preferably lower than 20%. The emulsions suitable to in the method of the present invention are of the type normally employed to obtain halftone, dot, and line images and are usually called lith emulsions. Said emulsions contain preferably at least 50 mole % of silver chloride, more preferably at least 80 mole % of silver chloride, most preferably at least 98 mole % of silver chloride, the remaining silver halide being silver bromide. If desired, the silver halide grains can contain a small amount of silver iodide, in an amount that is usually less than about 5 mole %, preferably 0% or less than 1 mole %. The silver halide grain average size is lower than about 0.4 micrometers, preferably lower than about 0.2 micrometers, more preferably lower than 0.15 micrometers. The term "grain size" refers to the diameter of a circle having the area of the same value as the average area projected by the silver halide crystals seen in an electron microscope. The silver halide grains may be those having a regular form, such as a cube or an octahedron, or those having an irregular crystal form, such as a sphere or tablet, etc., or may be those having a composite crystal form. The emulsions may be composed of a mixture of grains having different crystal forms.

The method of washing silver halide photographic emulsions of the present invention has a number of definite advantages. It provides for the reduction of the volume of water employed in the washing steps, permits the quick formation of a coagulum which is easily washed for a short time in water, and provides concentrated silver halide emulsions. A further advantage of the method of the present invention is that it reduces sedimentation and agglomaration in coagulation washing of very fine grain silver halide emulsions.

The following examples illustrate the present invention without limiting, however, the scope thereof.

EXAMPLE 1

Emulsion A

A silver halide emulsion containing 98% mole chloride and 2% mole bromide was prepared by adding 1,200 ml of a 5N silver nitrate solution and a mixed halide water solution, comprising 317 ml of 6N potassium bromode and 1,554 ml of 6N potassium chloride, to 2,820 ml of water comprising 132 g of normal gelatin at 36° C. in 30 minutes under stirring according to the conventional double jet technique. Cubic silver bromochloride grains were obtained having an average grain size of 0.09 micrometers and a variation coefficient of 18%

The emulsion was fed to an ultrafiltration unit fitted with polysulfone semipermeable membranes having a total working surface of 0.5 $m^2$ and a NMWL (Nominal Molecular Weight Limit) of 100,000 and washed at constant volume by ultrafiltration while continously adding demineralized water to the emulsion until the conductivity was 1,000 microS. The emulsion was reconstituted by adding an additional quantity of gelatin to give a final content of 94 g of gelatin per silver mole.

Emulsion B

Emulsion B was prepared as described for Emulsion A with the only difference being that the silver halide emulsion was washed as follows. The emulsion was coagulated by reducing pH to 3.1 by means of sulfuric acid and adding 750 g of sodium sulfate water solution. The emulsion coagulated and, after settling, the supernatant liquid was decanted. The coagulum was washed several times with demineralized water until the conductivity was 1,000 microS and reconstituted by adding an additional quantity of gelatin to give a final content of 94 g of gelatin per silver mole.

Emulsion C

Emulsion C was prepared as described for Emulsion A with the only difference being that the silver halide emulsion was washed as follows. The emulsion was coagulated by adding 150 ml of a 10% w/v water solution of sodium salt of poly(styrene sulfonic acid-co-maleic acid) having a 3:1 sodium styrene sulfonate to maleic acid mole ratio and a weight average molecular weight of 16,700 and reducing pH to 2.9 by means of sulfuric acid. The emulsion coagulated and, after settling, the supernatant liquid was decanted. The coagulum was washed several times with demineralized water until the conductivity was 1,000 microS and reconstituted by adding an additional quantity of gelatin to give a final content of 94 g of gelatin per silver mole.

Emulsion D

Emulsion D was prepared as described for emulsion A with the only differences being that:

a. 132 g of phthaloyl gelatin were used instead of normal gelatin at the silver halide precipitation step, and b. the silver halide emulsion was washed as follows.

The emulsion was coagulated by simply lowering pH to 3.5 by means of sulfuric acid. The settled coagulum was separated from the mother liquor by decantation, and the coagulum washed several times with demineralized water until the conductivity was 1,000 microS and reconstituted by adding an additional quantity of gelatin to give a final content of 94 g of gelatin per silver mole.

Emulsion E

Emulsion E was prepared as described for emulsion A with the only differences being that:

a. 132 g of phthaloyl gelatin were used instead of normal gelatin at the silver halide precipitation step, and b. the silver halide emulsion was washed as follows.

The emulsion was coagulated by adding 150 ml of a 10% w/v water solution of sodium salt of poly(styrene sulfonic acid-co-maleic acid) having a 3:1 sodium styrene sulfonate to maleic acid mole ratio and a weight average molecular weight of 16,700 (corresponding to 2.5 g of polymer per mole of silver) and reducing pH to 2.9 by means of sulfuric acid. The emulsion coagulated and, after settling, the supernatant liquid was decanted. The coagulum was washed several times with demineralized water until the conductivity was 1,000 microS and reconstituted by adding an additional quantity of gelatin to give a final content of 94 g of gelatin per silver mole.

The following Table 1 reports the settling time (minutes) of the coagulum, number of washings, washing time (minutes), water consumption (liters per silver mole) and weight of the coagulum (grams per silver mole) for each emulsion.

TABLE 1

| Emuls. | Settling Time | Washing Number | Washing Time | Water Consumpt. | Coagulum Weight |
|---|---|---|---|---|---|
| A | — | 1 | 45 | 5.0 | 500 |
| B | 30 | 6 | 180 | 6.0 | 1,100 |
| C | 15 | 5 | 75 | 3.6 | 450 |
| D | 15 | 4 | 60 | 4.0 | 470 |
| E | 5 | 3 | 15 | 2.4 | 300 |

By means of the process according to this invention illustrated by Emulsion E, the rate of settling of coagulates is greatly improved, the volume of water employed in the washing steps and the number and time of washing steps are reduced, and concentrated silver halide emulsions with reduced amounts of by-products and grain sedimentation can be obtained.

EXAMPLE 2

Five emulsions (F to L) were prepared and coagulated as described for Emulsion E of Example 1 using different amounts of sodium salt of poly(styrene sulfonic acid-co-maleic acid), i.e., 0.625, 1.25, 2.50, 3.75 and 5.00 g/mole silver, respectively. The following Table 2 reports the settling time (minutes) of the coagulum, number of washings, washing time (minutes), water consumption (liters per silver mole) and weight of the coagulum (grams per silver mole) for each emulsion.

TABLE 2

| Emuls. | Settling Time | Washing Number | Washing Time | Water Consumpt. | Coagulum Weight |
|---|---|---|---|---|---|
| F | 10 | 4 | 30 | 3.0 | 460 |
| G | 9 | 4 | 30 | 3.0 | 430 |
| H | 5 | 3 | 15 | 2.4 | 300 |
| I | 4 | 3 | 12 | 2.4 | 280 |
| L | 2 | 2 | 8 | 2.0 | 250 |

With the higher amount of sodium salt of poly(styrene sulfonic acid-co-maleic acid), difficulties in redispersing the coagulum have been encountered.

EXAMPLE 3

Emulsion M

A silver halide emulsion containing 98% mole chloride and 2% mole bromide was prepared by adding 1,200 ml of a 5N silver nitrate solution and a mixed halide water solution, comprising 317 ml of 6N potassium bromode and 1,554 ml of 6N potassium chloride, to 2,820 ml of water comprising 132 g of phthaloyl gelatin at 36° C. in 30 minutes under stirring according to the conventional double jet technique. Cubic silver bromochloride grains were obtained having an average grain size of 0.09 micrometers and a variation coefficient of 18%.

The emulsion was coagulated by adding 150 ml of a 10% w/v water solution of sodium salt of polystyrene sulfonic acid having a weight average molecular weight of 300,000 and reducing pH to 2.9 by means of sulfuric acid. The emulsion coagulated and, after settling, the supernatant liquid was decanted. The coagulum was washed several times with demineralized water until the conductivity was 1,000 microS and reconstituted by adding an additional quantity of gelatin to give a final content of 94 g of gelatin per silver mole.

Emulsion N

Emulsion N was prepared as described for Emulsion M with the only difference being that the silver halide emulsion was washed as follows. The emulsion was coagulated by adding 150 ml of a 10% w/v water solution of sodium salt of poly(styrene sulfonic acid-co-maleic acid) having a 4:1 sodium styrene sulfonate to maleic acid mole ratio and a weight average molecular weight of 150,000 and reducing pH to 2.9 by means of sulfuric acid. The emulsion coagulated and, after settling, the supernatant liquid was decanted. The coagulum was washed several times with demineralized water until the conductivity was 1,000 microS and reconstituted by adding an additional quantity of gelatin to give a final content of 94 g of gelatin per silver mole.

The following Table 3 reports the settling time (minutes) of the coagulum, number of washings, washing time (minutes), water consumption (liters per silver mole) and weight of the coagulum (grams per silver mole) for each emulsion.

TABLE 3

| Emuls. | Settling Time | Washing Number | Washing Time | Water Consumpt. | Coagulum Weight |
|---|---|---|---|---|---|
| M | 4 | 3 | 15 | 2.4 | 380 |
| N | 5 | 3 | 15 | 2.4 | 300 |

Emulsion M comprising polystyrene sulfonic acid, despite good results during washing operations, was very difficult to redisperse. Emulsion N of the present invention was very easy to redisperse.

We claim:

1. A method of preparing a washed silver halide photographic emulsion comprising the steps of forming a dispersion of silver halide grains in the presence of a hydrophilic colloid and removing undesirable by-products of silver halide grain-formation by lowering the pH to bring about coagulation and by washing coagulum formed in dispersing silver halide grains, the method being characterized by the fact that said hydrophilic colloid comprises an acid-coagulable gelatin derivative and said coagulation is effected in the presence of an ionic copolymer comprising monomer units of:

(a) a water-soluble salt of a styrene sulfonic acid, and (b) maleic acid, the molar ratio of (a) to (b) being at least 1:1 up to 9:1.

2. Method according to claim 1, wherein the ionic copolymer of styrene sulfonic acid and maleic acid comprises a copolymer of sodium styrene sulfonate and maleic acid in a 2:1 to 4:1 mole ratio.

3. Method according to claim 1, wherein said gelatin derivative is phthaloyl gelatine.

4. Method according to claim 1, wherein said gelatin derivative is phenylcarbamoyl gelatin.

5. Method according to claim 1, wherein said acid-coagulable gelatin derivative comprises at least 50% by weight of the hydrophilic colloid.

6. Method according to claim 1, wherein the pH to bring about coagulation is lowered to a value below 4.

7. Method according to claim 1, wherein the ionic copolymer of styrene sulfonic acid and maleic acid is added after silver halide grain-formation.

8. Method according to claim 1, wherein the ionic copolymer of styrene sulfonic acid and maleic acid is used in an amount comprised between about 5% and about 60% by weight relative to the amount of said gelatin derivative.

9. Method according to claim 1, wherein the after washing coagulum, the washed coagulum is redispersed with water and hydrophilic colloid.

10. A method of preparing a washed silver halide photographic emulsion comprising the steps of forming a dispersion of silver halide grains in the presence of a hydrophilic colloid and removing undesirable by-products of silver halide grain-formation by lowering the pH to bring about coagulation and by washing coagulum formed in dispersing silver halide grains, the method being characterized by the fact that said hydrophilic colloid comprises an acid-coagulable gelatin derivative and said coagulation is effected in the presence of an ionic copolymer comprising monomer units of:

(a) a water-soluble salt of a styrene sulfonic acid, and (b) maleic acid, the molar ration of (a) to (b) being at least 1:1 up to 9:1 and said copolymer having ammonium or alkali metal salts of sulfonic acid groups on said copolymer.

11. The method of claim 10 wherein said ionic copolymer comprises a copolymer of sodium styrene sulfonate and maleic acid in a 2:1 to 4:1 molar ratio.

12. The method of claim 10 wherein said gelatin derivative comprises phthaloyl gelatin or phenylcarbamoyl gelatin.

13. The method of claim 10 wherein said acid-coagulable gelatin derivative comprises at least 50% by weight of the hydrophilic colloid.

14. The method of claim 10 wherein the pH to bring about coagulation is less than 4.

* * * * *